US005160140A

United States Patent [19]

Starrett

[11] Patent Number: 5,160,140

[45] Date of Patent: Nov. 3, 1992

[54] EXPANDABLE BATON WITH SPRING BIASED LATCH MEANS

[75] Inventor: Paul D. Starrett, Jaffrey, N.H.

[73] Assignee: Monadnock Lifetime Products, Inc., Fitzwilliam, N.H.

[21] Appl. No.: 702,368

[22] Filed: May 15, 1991

Related U.S. Application Data

[63] Continuation of Ser. No. 413,826, Sep. 28, 1989, abandoned.

[51] Int. Cl.[5] ..... F41B 15/02

[52] U.S. Cl. ..... 273/84 R; 403/109

[58] Field of Search ..... 273/80 D, 84 R; 403/108, 109, 166, 322, 325, 326, 327, 377; 135/26, 29, 37, 38, 39, 40, 75, 107, 108

[56] References Cited

U.S. PATENT DOCUMENTS

| | | | |
|---|---|---|---|
| D. 230,150 | 1/1974 | Anderson | 273/84 R |
| 1,648,806 | 11/1927 | Hadden | 273/80 D |
| 3,366,406 | 1/1968 | Morris | 273/80 D |
| 3,371,930 | 3/1968 | Shiga | 273/84 R |
| 4,037,839 | 7/1977 | Nelson | 273/84 R |
| 4,365,808 | 12/1982 | Perez | 273/84 R |

FOREIGN PATENT DOCUMENTS

| | | | |
|---|---|---|---|
| 3808362 | 10/1988 | Fed. Rep. of Germany | 273/84 R |

OTHER PUBLICATIONS

Monadnock Lifetime Products, Inc, Product brochure of expandable baton PR24X and SX-24, May 22, 1989.

*Primary Examiner*—Theatrice Brown
*Assistant Examiner*—William M. Pierce
*Attorney, Agent, or Firm*—Donald Brown

[57] ABSTRACT

An expandable police baton embodying a cylindrical sleeve within which is slidably disposed a cylindrical shaft and further embodying structure for limiting the position of the shaft on the one hand within the sleeve and on the other hand expanded therefrom. Preferably, the sleeve is comprised of aluminum and the shaft is comprised of polycarbonate or aluminum. A spring-biased nylon steel pin assembly is employed to limit contraction and extension of the shaft relative to the sleeve and a shock absorbent plug is employed to constrain extension.

9 Claims, 2 Drawing Sheets

EXPANDABLE BATON WITH SPRING BIASED LATCH MEANS

This is a continuation of copending application Ser. No. 07/413,826 filed on Sep. 28, 1989, now abandoned.

BACKGROUND OF THE INVENTION

Conventional police batons are in the form of a rigid, one-piece, elongate, inextensible structure of solid cross section. It is the purpose of this invention to provide a two-piece structure comprising a rigid, elongate, tubular structure and a rigid, elongate shaft of solid cross section disposed in the tube and movable therein relative to the tube from a contracted position confined within the tube to an expanded position projecting from the tube. This invention allows the police officer to carry the police baton easier when it is in the collapsed position. Also, when the officer opens the expandable baton, it gives the officer an "element of surprise" not provided by other batons.

SUMMARY OF THE INVENTION

A police baton of two-piece construction comprising a hollow cylindrical frame in the form of a tube, and a cylindrical shaft of solid cross section telescopically disposed in the frame. The frame has at opposite ends radially-disposed holes, and the cylindrical shaft has at one end a radially-disposed, spring-biased latch pin yieldably engageable within the holes to hold the shaft in one position telescoped within the frame and in a second position extending from the frame. The shaft contains a longitudinally-disposed groove and there is a stop fixed to the frame slidably engaged within the groove for limiting expansion of the shaft relative to the frame. A radially-disposed yieldable bumper is recessed into the shaft adjacent the latch pin for cushioning engagement with the stop. The hollow, cylindrical frame has at one end external knurling providing a hand grip, is open at said end such to permit removing the shaft and internally threaded at said end for receiving a cap against a resilient ring. A radially-disposed, yieldable bumper is recessed into the shaft adjacent the latch pin for constraining expansion of the shaft.

In one form, a resilient ring is disposed about the handle at the base of the knurling and in another form a side handle is secured to the shaft at the base of the knurling.

Desirably, the frame is comprised of aluminum and the shaft is comprised of polycarbonate.

BRIEF DESCRIPTION OF THE DRAWINGS

The invention will now be described in greater detail with reference to the accompanying drawings, wherein.

Figure 1:
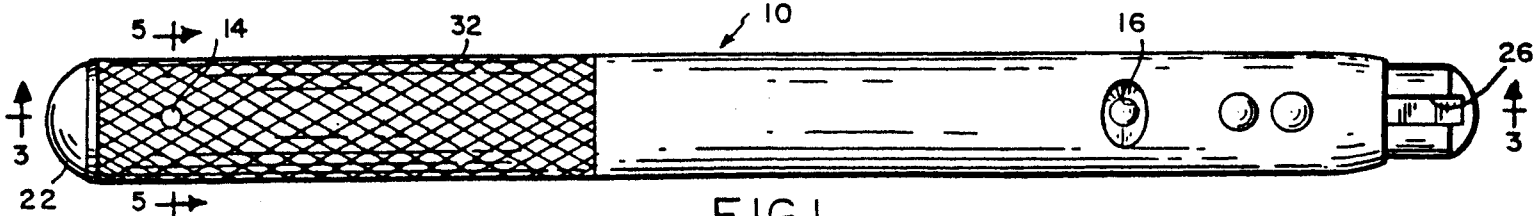
FIG. 1 is a plan view of a police baton constructed according to this invention embodying expandable parts with the parts contracted.
Figure 2:
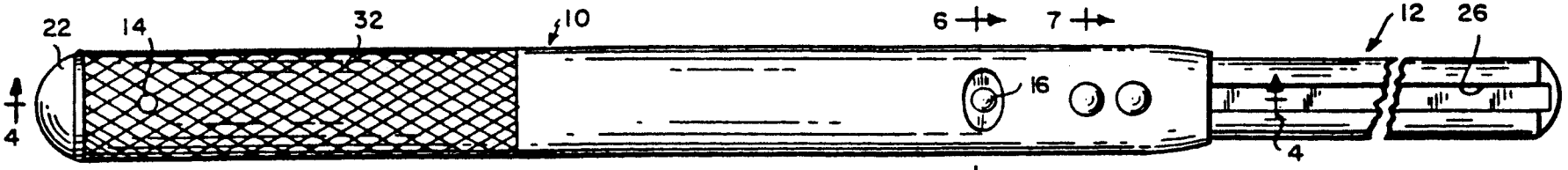
FIG. 2 is a plan view of the baton shown in FIG. 1 with the parts partially expanded.

Referring to the drawings, the police baton of this invention comprises a cylindrical sleeve in the form of a hollow tube 10 within which is slidably mounted a cylindrical shaft 12 of solid cross section. The sleeve 10 contains longitudinally-disposed holes 14 and 16 and the shaft 12 is provided at one end with a radial recess 19 containing a spring-biased pin 18, 20 engageable with the holes 14 and 16 to hold the shaft 12 on the one hand contained within the sleeve, FIG. 3, and on the other hand extending from the sleeve, FIG. 4. The spring biased pin 18, 20 is disposed in the radial recess 19 formed in the shaft 12.

The sleeve 10 has open ends and a cap 22 is threaded into one open end of the sleeve against a resilient ring 24. The cap 22 can be removed to permit the shaft 12 to be removed from the sleeve.

Figure 3:
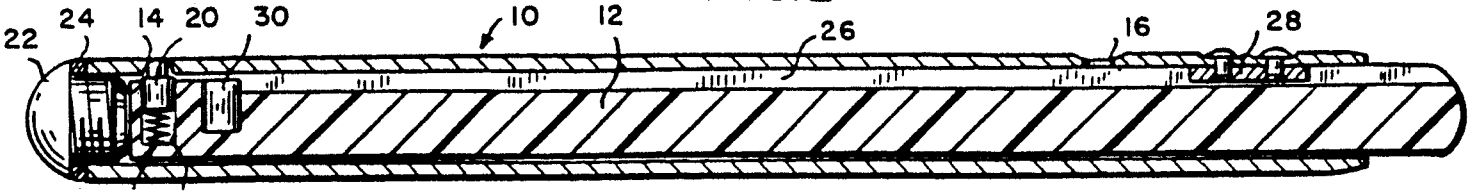
FIG. 3 is a diametrical section taken on the line 3—3 of FIG. 1.
Figure 4:
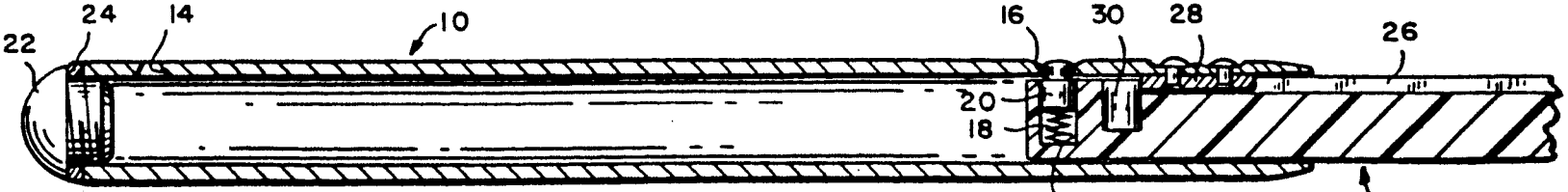
FIG. 4 is a diametrical section taken on the line 4—4 of FIG. 2.
Figure 5:
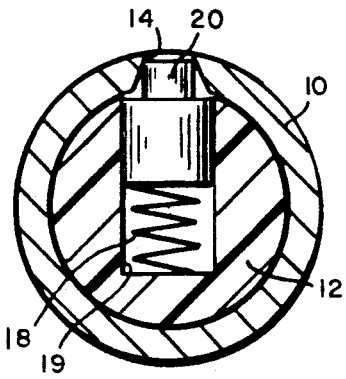
FIG. 5 is a section taken on the line 5—5 of FIG. 1.
Figure 6:
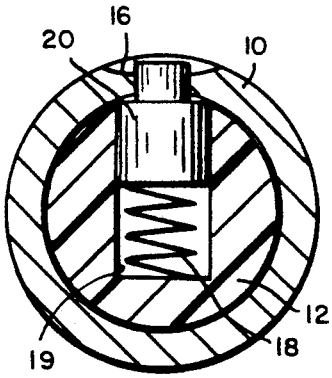
FIG. 6 is a section taken on the line 6—6 of FIG. 2.
Figure 7:
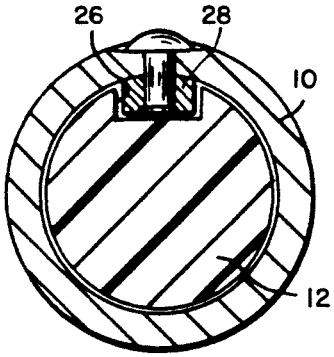
FIG. 7 is a section taken on the line 7—7 of FIG. 2.

The shaft 12 has longitudinally thereof a groove 26, FIGS. 3 and 4, of rectangular cross section and there is a key 28 riveted within the sleeve in slidable engagement with the groove 26 for limiting extension of the shaft 12 relative to the sleeve 10.

A resilient bumper 30, FIGS. 3 and 4, is recessed into the shaft 12 ahead of the spring-biased pin 18, 20 to cushion the expansion of the shaft 12 as it is expanded from the sleeve.

The sleeve 10 is comprised of aluminum anodized on its surface, the shaft 12 is comprised of polycarbonate or aluminum and the spring-biased pin 20 is comprised of steel with black oxide on its surface and nylon.

To afford a firm grip on the baton, a portion 32 adjacent the closed end of the tube is knurled.

Figure 10:
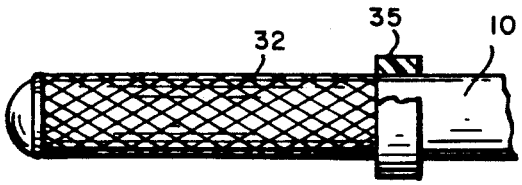
FIG. 10 is a fragmentary plan view of FIG. 1 showing a ring disposed about the handle at the base of the knurling.

An annular rubber ring 35, FIG. 10, is disposed about the sleeve 10 at the base of the knurling as a support for suspending the baton in a holster.

Figure 8:
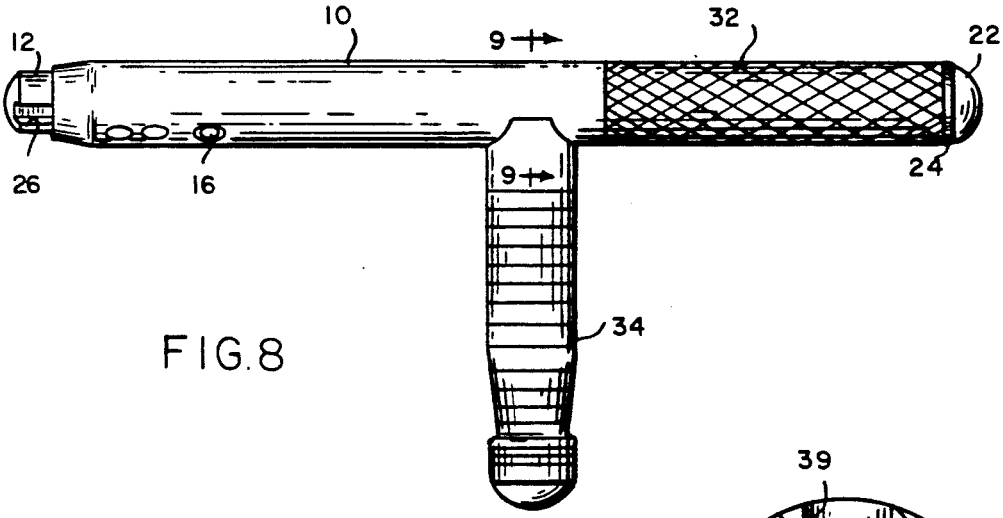
FIG. 8 is an elevation of a modification embodying a side handle.
Figure 9:
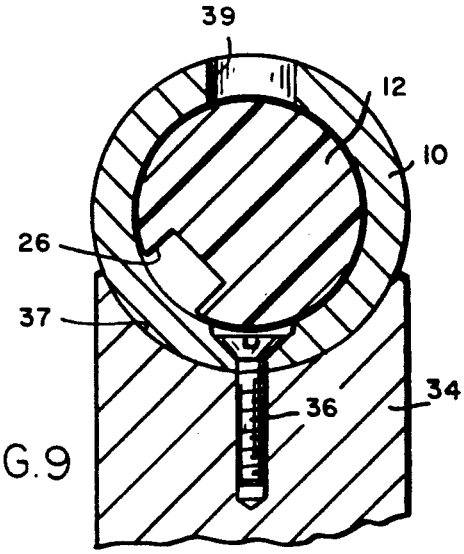
FIG. 9 is a section taken on the line 9—9 of FIG. 8.

Referring to FIGS. 8 and 9, the baton may be provided with a radially-disposed side handle 34 fixed to the sleeve by a threaded screw 36 screwed into the handle 34. Diametrically opposite the screw, there is an access opening 39 for receiving the screw. The end of the side handle 34 is recessed at 37 to receive the baton.

The outside diameter of the sleeve 10 is 1.25 inches and the outside diameter of the shaft 12 is 1 inch. The contracted length of the parts 10 and 12 is 14 inches and the expanded length is 24 inches. The handle 34 is approximately 6 inches long and 1 inch in diameter.

It should be understood that the present disclosure is for the purpose of illustration only and includes all modifications or improvements which fall within the scope of the appended claims.

What is claimed is:

1. A police club comprising first and second telescoping parts slideably movable relative to each other from a position in which the second of the parts is substantially contracted within the first part to a position in which the parts are substantially totally expanded relative to each other and a radially-disposed, spring-biased pin mounted in the second of the parts and engageable with first and second openings in the first part to hold the parts expanded when the pin is positioned in the first of said openings and contracted when the pin is positioned in the second of said openings, the first of said openings being greater in size than the pin whereby the pin extends through said opening and beyond the opening in the radial direction and wherein the second of said openings is of a size to retain said pin, but prevent it from extending through said second opening, and whereby said second opening has a reverse countersunk shaped wall, whereby the pin can slide out of said second opening along said wall when the first and second telescoping parts are moved apart from one another.

2. A police club according to claim 1 in which one of the parts is of hollow cross section and the other of the parts is of solid cross section.

3. A police baton according to claim 2 wherein the outside diameter of said one part is 1.25 inches and the outside diameter of the other part is 1.00 inches.

4. Apparatus according to claim 1 wherein the parts are of circular cross section.

5. A police baton according to claim 1 wherein the contracted length of the parts is approximately 14 inches.

6. A police baton according to claim 1 wherein the expanded length of the parts is 24 inches.

7. A police baton according to claim 1 wherein the ends of the baton are hemispherical.

8. A police baton comprising a hollow, cylindrical, elongate frame, a cylindrical shaft telescopically disposed in said frame, said cylindrical frame having a first hole in the interior side wall thereof and a second hole in the interior side wall thereof in longitudinal alignment with said first hole, a spring-biased pin yieldably engageable within the holes of the frame to hold the shaft in one position telescoped within the frame and in a second position expanded from the frame, said pin positioned in the first of said holes when in a retracted position telescoped within said frame and said pin positioned in the second of said holes when in a position expanded from said frame, said first of holes of a shape having a reverse countersunk shaped wall, whereby the pin slideably moves along said reverse countersunk shaped wall when it enters the hole or leaves the hole and said second of said holes extends through said frame, whereby said pin is able to extend into said second hole and beyond the frame portion defining the second hole when positioned in the second hole.

9. A police baton comprising a hollow, cylindrical, elongate frame, a cylindrical shaft telescopically disposed in said frame, said cylindrical frame having a first hole in the interior side wall thereof and a second hole in the interior side wall thereof in longitudinal alignment with said first hole, a spring-biased pin yieldably engageable within the holes of the frame to hold the shaft in one position telescoped within the frame and in a second position expanded from the frame, said pin positioned in the first of said holes when in a retracted position telescoped within said frame and said pin positioned in the second of said holes when in a position expanded from said frame, said first of holes of a shape having a reverse countersunk shaped wall, whereby the pin slideably moves along said reverse countersunk shaped wall when it enters the hole or leaves the hole and said second of said holes extends through said frame, whereby said pin is able to extend into said second hole and beyond the frame portion defining the second hole when positioned in the second hole, said first hole extends through said frame and whereby said reverse countersunk shaped wall is of a dimension which prevents said pin from extending through said first hole and beyond said frame portion defining said first hole.

* * * * *